US009324487B1

(12) United States Patent
Wei et al.

(10) Patent No.: US 9,324,487 B1
(45) Date of Patent: Apr. 26, 2016

(54) DAMPER FOR MAGNETIC COUPLER

(71) Applicant: Amazon Technologies, Inc., Reno, NV (US)

(72) Inventors: Eric Jeffrey Wei, Sunnyvale, CA (US); Patrick Clement Strittmatter, Saratoga, CA (US); Duc Ngo, San Jose, CA (US); Allen Weihua Liu, San Ramon, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/302,259

(22) Filed: Jun. 11, 2014

(51) Int. Cl.
*H01F 7/00* (2006.01)
*H01F 7/02* (2006.01)

(52) U.S. Cl.
CPC ..... *H01F 7/0221* (2013.01)

(58) Field of Classification Search
CPC ..... F16F 9/532; F16F 9/533; F16F 9/348; F16F 9/14; F16F 9/34; F16F 7/1011; F16F 2222/06
USPC ..... 335/219
See application file for complete search history.

(56) References Cited

U.S. PATENT DOCUMENTS 3,034,025 A * 5/1962 Frances et al. ..... 335/295
3,232,654 A * 2/1966 Israelson et al. ..... 292/251.5
3,411,117 A * 11/1968 Jencks et al. ..... 335/61
4,652,845 A * 3/1987 Finkle ..... 335/285
6,005,460 A * 12/1999 Garrigus et al. ..... 335/216
6,086,125 A * 7/2000 Kovacs et al. ..... 294/65.5
6,538,544 B1 * 3/2003 Hardy ..... 335/285
6,707,360 B2 * 3/2004 Underwood et al. ..... 335/288
6,940,373 B2 * 9/2005 Hintz et al. ..... 335/31
7,915,986 B2 * 3/2011 Lu ..... 335/285
2011/0073118 A1 * 3/2011 Ponsort et al. ..... 128/845
2011/0248806 A1 * 10/2011 Michael ..... 335/295
2011/0260383 A1 * 10/2011 Ruden et al. ..... 269/8
2012/0092104 A1 * 4/2012 Kocijan ..... 335/295
2013/0285399 A1 * 10/2013 Sarh et al. ..... 294/65.5
2015/0028975 A1 * 1/2015 Kamiunten ..... 335/295

OTHER PUBLICATIONS

"Dashpot," Wikipedia, availble at <<http://en.wikipedia.org/wiki/Dashpot>>, retreived Jun. 13, 2014, 3 pages.
"Magsafe," Wikipedia, available at <<http://en.wikipedia.org/wiki/MagSafe, retreived Jun. 13, 2014, 7 pages.

* cited by examiner

*Primary Examiner* — Shawki S Ismail
*Assistant Examiner* — Lisa Homza
(74) *Attorney, Agent, or Firm* — Lee & Hayes, PLLC

(57) ABSTRACT

This disclosure is directed at least partly to reducing an acceleration of a magnet when a magnet is moved toward an attracting object. An apparatus may include a dampening mechanism to dissipate kinetic energy of the magnet as it traverses within a housing from a first position to a second position. The housing may be at least partially coupled to another surface as a result of a magnetic attraction when the magnet is located in the second position. The dampening mechanism may include use of a fluid and/or gas that is displaced by the magnet to slow acceleration of the magnet as the magnet traverses between the first position and the second position. In some embodiments, the dampening mechanism may be implemented using threads that cause rotation of the magnet or by rollers that slow acceleration of the magnet.

20 Claims, 10 Drawing Sheets

DAMPER FOR MAGNETIC COUPLER

BACKGROUND

Magnets are becoming more ubiquitous in some devices as a means of attaching two objects together. For example, an electronic device may include magnets to couple accessories and/or cables to the device, such as a power cord or a display cover. However, use of magnets in these applications may have some disadvantages. As with any magnet, these magnets may adversely affect other devices, such as by demagnetizing and erasing data from magnetic stripes on payment cards. These magnets also often have a high magnetic attachment force that increases as the distance between coupling objects decreases. This may create a problem of accelerating the two objects very quickly, which may be undesirable to some users.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Overview

Figure 1A:
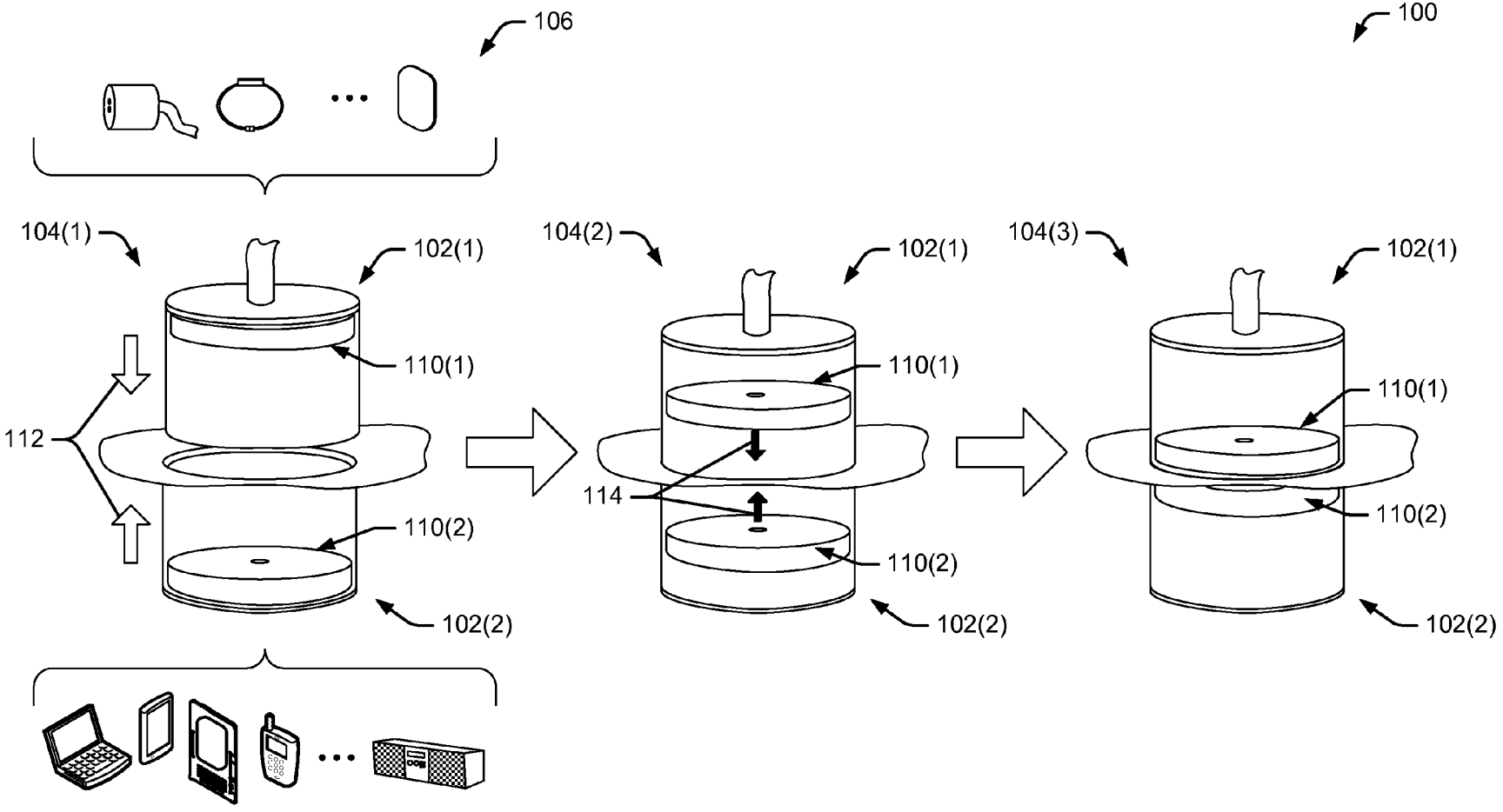
FIG. 1A is a schematic diagram showing a coupling sequence that illustrates operation of damper for a magnetic coupler.

This disclosure is directed at least partly to reducing an acceleration of a magnet when a magnet is moved toward an attracting object, such as during coupling of a first surface with a second surface. An apparatus may include a dampening mechanism to dissipate kinetic energy of the magnet as it traverses within a housing from a first position to a second position. The housing may be at least partially coupled to another surface as a result of a magnetic attraction when the magnet is located in the second position. For example, the magnetic attraction may couple the surfaces along a first axis (e.g., x axis), while features of the housing may prevent sheer forces from uncoupling the housing in other axes (e.g., y and z axes). Further, the dampening mechanism may exhibit no force against the magnet when the magnet is located in the second position. As discussed herein, the magnet may be a rare earth magnet, a composite magnet, a ferromagnet, or an electromagnet. By using the dampening mechanism, a magnet having a higher gauss value may be selected for use in a coupling application, such as a magnet having a gauss of 3000 G or greater.

As an example, the housing may be part of an electrical connector that connects to a complementary surface of a device. The connector may have a coupling surface located proximate to the second position and a ferrous plate located proximate to the first position. Before the connector is moved in contact with the device, the magnet may be attracted to the ferrous plate, and thus may reside in the first position. After the connector is situated such that the coupling surface is moved in contact with the complementary surface of the device, an attractive force caused from the positioning of the device (e.g., by a magnet in the device, etc.) may cause the magnet to be attracted toward the device, and thus cause the magnet to traverse from the first position to the second position. The dampening mechanism may slow the traversing from the first position to the second position. When the connector is decoupled such that the coupling surface is moved away from the complementary surface of the device, an attractive force caused from the ferrous plate may cause the magnet to be attracted toward the ferrous plate, and thus cause the magnet to traverse from the second position to the first position, thereby resetting the dampening mechanism.

In some embodiments, the dampening mechanism may include a fluid that is displaced by the magnet as the magnet traverses between the first position and the second position. The housing may include a sealed cavity (also referred to herein as a fluid reservoir) that includes the fluid and the magnet. When the magnet is located at an intermediary position between the first position and the second position within the housing, the magnet may divide the sealed cavity into two primary volumes separated by the magnet, which are each filled with the fluid. As the magnet traverses toward one of the positions, fluid from the volume that is being compressed flows toward the volume that is being expanded. The fluid may flow through one or more apertures in the magnet. The flow of fluid through the one or more apertures in the magnet may dissipate the kinetic energy of the magnet as the magnet traverses from the first position to the second position and reduce an acceleration of the magnet.

In various embodiments, the dampening mechanism may cause dissipation of kinetic energy by controlled movement of fluid or gas within the housing or controlled movement of the magnet. For example, the magnet may traverse from the first position to the second position along a spline that includes threads that cause rotation of the magnet relative to the spline and the housing. The rotation of the magnet may dissipate some of the kinetic energy of the magnet (through increased friction) while slowing the linear acceleration of the magnet toward the second surface. As another example, special rollers may slow the acceleration of the magnet during traversing from the first position to the second position. The rollers may be designed to offer resistance when rotated in a first direction and offer little or no resistance when rotated in an opposite direction, such as by employing a freewheel. In still another example, a valve may be coupled to the magnet (e.g., attached, integrally formed, etc.) and may be used to hinder a flow of fluid or gas in a first direction through an aperture in the magnet while refraining from hindering flow, or at least hindering flow to a lesser degree, when the fluid or gas travel through the valve in the aperture in a second, opposite direction. The valve may include fins that deflect to increase a size of an orifice when fluid flows in a first direction and that deflect in an opposite direction to reduce the size of the orifice when fluid flows in a second, opposite direction.

The apparatuses described herein may be implemented in a number of ways. Example implementations are provided below with reference to the following figures.

FIG. 1A shows a coupling sequence 100 that illustrates operation of a damper for a magnetic coupler. The coupling sequence 100 involves magnetic coupling of a first coupler 102(1) and a second coupler 102(2) through three sequences 104(1), 104(2), and 104(3). The first coupler 102(1) may be part of a first object 106 such as a cord, an accessory, or other type of device that connects to the second coupler 102(2), which may be part of a second object 108 such as an electronic device or other type of object or device (or another part of the first object, such as with a bracelet). The first coupler 102(1) may include a first magnet 110(1) that traverses within the first coupler 102(1). Likewise, the second coupler 102(2) may include a second magnet 110(2) that traverses within the second coupler 102(2).

The first sequence 104(1) shows convergence, as represented by arrows 112, of the first coupler 102(1) towards the second coupler 102(2). In the second sequence 104(2), the first coupler 102(1) is coupled to (e.g., mated, touching, etc.) the second coupler 102(2). The second sequence 104(2) also shows the first magnet 110(1) moving, as represented by an arrow 114, within the first coupler 102(1) towards the second magnet 110(2), which is moving, as represented by the arrow 114, within the second coupler 102(2). The third sequence 104(3) shows the first coupler 102(1) coupled to the second coupler 102(2) with the first magnet 110(1) being located proximate to the second magnet 110(2). In this position, the magnets exhibit a maximized attraction force toward each other, and thus act to couple the couplers together.

The magnets are dampened during the traversing shown in the sequences 104(1), 104(2), and 104(3), such as by movement of fluid through one or more apertures in the respective magnets or by other techniques and/or apparatuses described herein. The damper operates to slow the movement of the magnet within the respective couplers, and thus prevent a snapping action when the couplers are coupled. In addition, the damper further reduces exposure to a magnetic field of the magnet when the magnet is retreated in the coupler as shown in the first sequence 104(1).

Figure 1B:
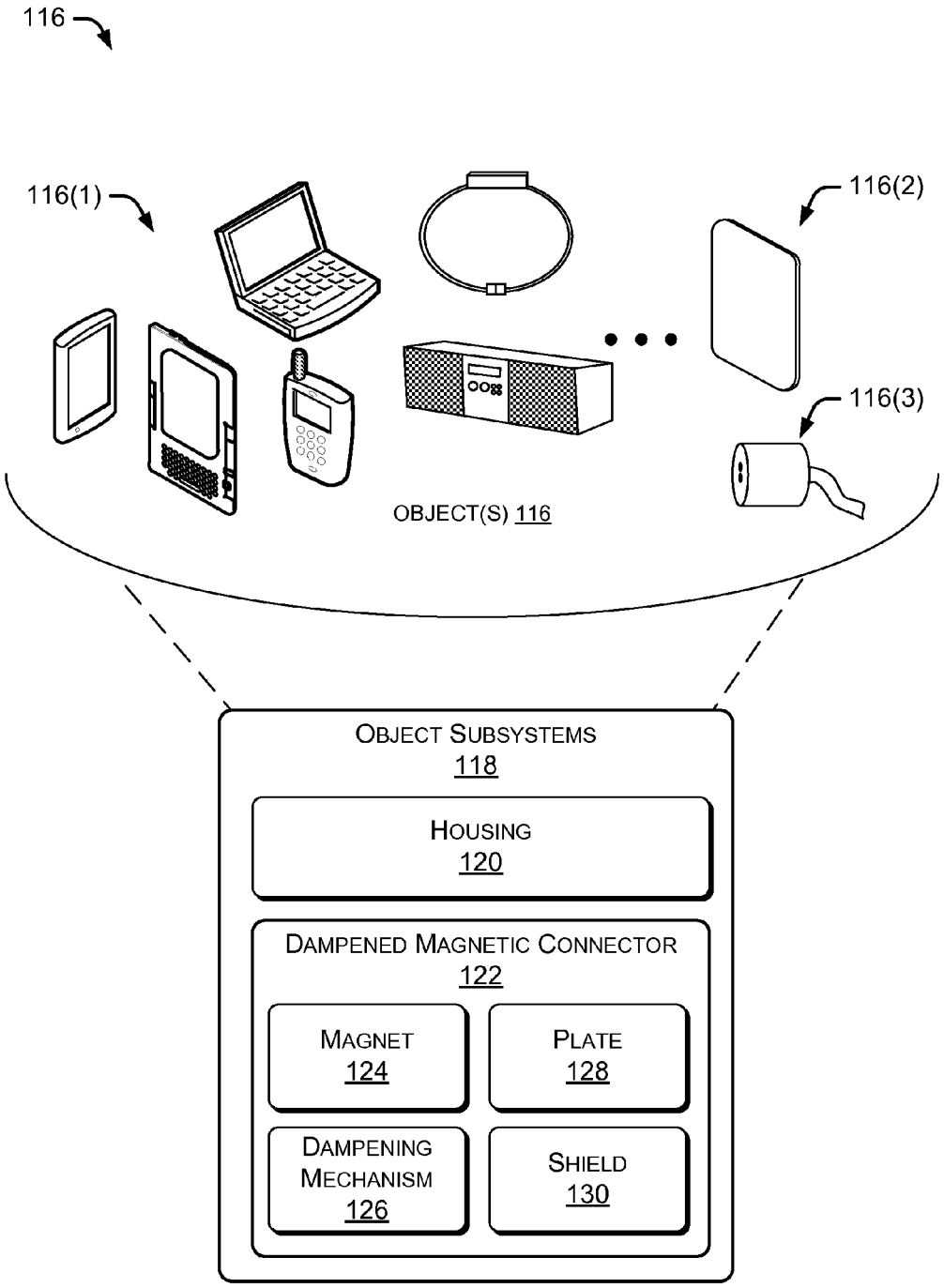
FIG. 1B is a schematic diagram of an illustrative object that includes a damper for a magnetic coupler.

FIG. 1B is a schematic diagram of an illustrative object 116 that includes a damper for at least one magnetic coupler. The object 116 may include a device 116(1) such as electronic devices or other devices that couple to other objects (e.g. a cord, an accessory) or couple to itself (e.g., a bracelet, a belt, a necklace, a carry strap, etc.). The object may include an accessory 116(2) that couples to one of the devices 116(1) or a corded connector 116(3) that couples to one of the devices 116(1) and/or one of the accessories 116(2). Examples of the corded connector 116(3) may include a power cord, a universal serial port (USB) cable connector, an optical fiber connector, and so forth.

As shown in FIG. 1B, the objects 116 may include subsystems 118. The subsystems may include a housing 120 and a dampened magnetic connector 122. The housing 120 may include features to accommodate coupling to or by another object or another part of the object (e.g., in the case of a bracelet, etc.). For example, the housing 118 may include a recess, cavity, and/or other features that are complementary to a profile of a mating surface of another object that couples to the housing 118, which may assist in alignment, coupling, aesthetics, or other aspects.

The dampened magnetic connector 122 may include a magnet 124 that traverses between a first position and a second position within the housing 120. The magnet 124 may cause the object to be coupled to another object at least partially by magnetic attraction directed from or proximate to a coupling surface of the housing 120 and toward a complementary surface of another object when the magnet 124 is in the second position. A dampening mechanism 126 may reduce an acceleration of the magnet 124 as it traverses from the first position to the second position. The dampening mechanism 126 may dissipate kinetic energy of the magnet as it traverses within the housing 120. The dampening mechanism may use fluid, gas, mechanical features, and/or other elements to perform the dampening. In some embodiments, the dampening mechanism 126 may exhibit no force against the magnet when the magnet is located in the second position within the housing 120, thereby allowing the magnet to maximize its magnetic force.

The dampening magnetic connector 122 may include a plate 128 to cause the magnet 124 to traverse to the first position within the housing 120 when the housing is not attracted to the complementary surface of the other object. The plate 128 may be a ferrous plate or repository and may be formed in various shapes based on design requirements. In some embodiments, the dampened magnetic connector 122 may include a shield 130 to prevent or limit exposure by other surfaces/objects to an amount of a magnetic force of the magnet 124. For example, the shield 130 may be used to magnetically insulate at least part of the housing.

Figure 2A:
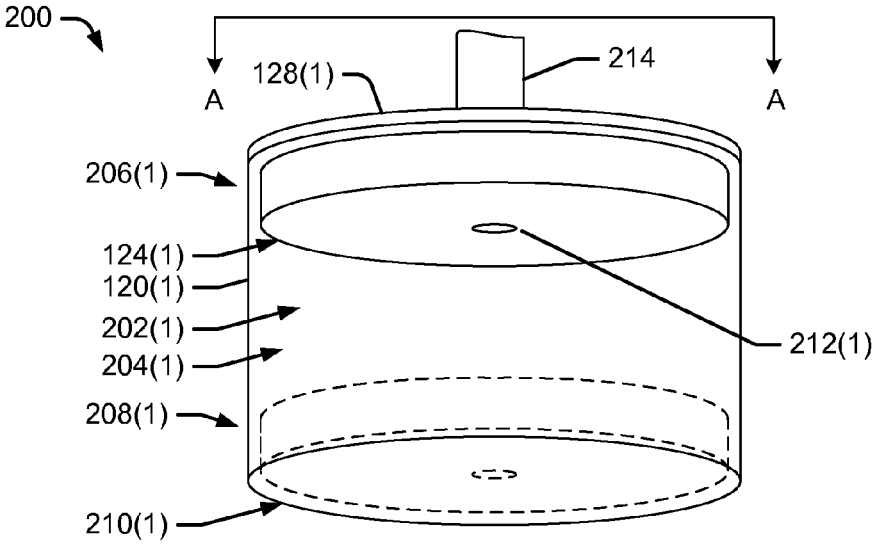
FIG. 2A is an isometric view of an illustrative damper for a magnetic coupler arranged with a connector.

FIG. 2A is an isometric view of an illustrative damper for a magnetic coupler 200 arranged with a connector. For description purposes, the magnetic coupler may be referred to as a first magnetic coupler when discussed in relation to a second magnetic coupler that corresponds to the first magnetic coupler. The second magnetic coupler is discussed with reference to FIG. 2B. Elements that indicate a "(1)" refer to the first magnetic coupler (the magnetic coupler 200) while elements that include a "(2)" refer to the second magnetic coupler, discussed below.

The magnetic coupler 200 may be configured for coupling a corded object to a device, such as an electronic device. However, the magnetic coupler 200 may be used to couple virtually any two object together that are otherwise capable of being coupled by magnetic attraction. For example, the magnetic coupler 200 may couple an accessory to an electronic device or couple one part of an object to another part of a same object, such as to secure a watch or bracelet to a person's wrist.

The magnetic coupler 200 includes a housing 120(1). The housing 120(1) may be formed in various different shapes based on a desired configuration and use of the housing or associated object that includes the housing. For example, the housing 120(1) may have a cross-section that is a parallelogram, circular, oval, triangular, or shaped in other configurations.

The housing 120(1) may include an interior cavity 202(1). In some embodiments, the interior cavity 202(1) may be a sealed cavity that contains a magnet 124(1) and fluid 204(1). The fluid 204(1) may be selected based on one or more properties of the fluid, such as a viscosity, an operating temperature range of the fluid (e.g., a freezing point and a vaporization point), magnetic shielding properties, and so forth. Example fluids include corn syrup and glycerin; however, other fluids or combinations of fluids may be suitable based on desired dampening characteristics of the dampening mechanism. In some embodiments, the fluid 204(1) may include a viscosity of at least 10,000 centipoise. In various embodiments, the interior cavity 202(1) may contain a gas or mixture of gases, or contain no gas or fluid and thus create a vacuum.

As discussed above, the magnet 124(1) may traverse within the housing from a first position 206(1) to a second position 208(1). The first position 206(1) may be proximate to a plate 128(1) that attracts the magnet 124(1) in the absence of a stronger magnetic attractive force. The second position 208(1) may be proximate a coupling surface 210(1), which may be coupled adjacent to another corresponding coupling surface. A space occupied by the magnet 124(1) when the magnet is in the second position 208(1) is shown in FIG. 2A (and other figures herein) using dashed lines. When the coupling surface 210(1) is adjacent the other corresponding coupling surface that has a magnetic attractive force greater than the attractive force of the plate 128(1), then the magnet 124(1) may traverse from the first position 206(1) to the second position 208(1). During the traversing, the fluid 204(1) may travel through an aperture 212(1) in the magnet 124(1), and thereby act as a damper to slow acceleration of the magnet 124(1) during the traversing. In accordance with some embodiments, the housing 120(1) may include a cord 214. The cord 214 may connect the housing 120(1) to another object and/or may include one or more of cables, fibers, or other materials to transfer electricity, light, and so forth.

In some embodiments the fluid may flow around the magnet, such as when the magnet does not extend completely across the width (or diameter) of the housing. In such embodiments, an aperture may be optional and a guiding spline and/or guiding features may be included to direct the traversing of the magnet along a single axis.

Figure 2B:
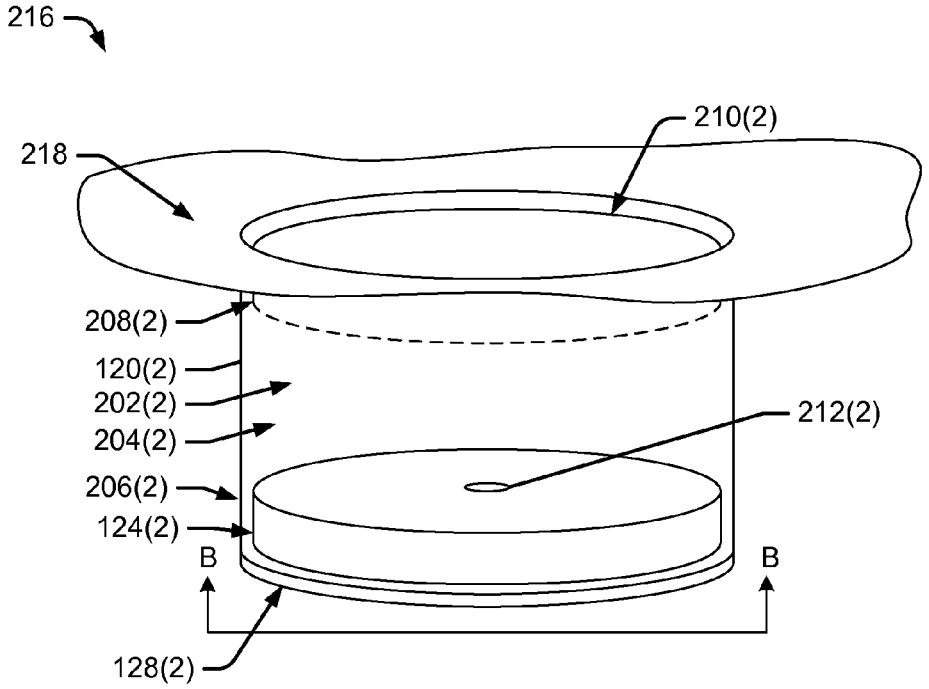
FIG. 2B is an isometric view of an illustrative damper for a complementary magnetic coupler arranged with a device and configured to receive the connector shown in FIG. 2A.

FIG. 2B is an isometric view of an illustrative damper for a complementary magnetic coupler 216 arranged with a device and configured to receive the connector shown in FIG. 2A. The complementary magnetic coupler 216 may include virtually the same or similar components as the magnetic coupler 200 described with reference to FIG. 2A. The same or similar components of the magnetic coupler 216 are designated with a "(2)" in reference to these components. For example, the magnetic coupler 216 may include a housing 120(2) that includes an interior cavity 202(2) that contains a magnet 124(2) and fluid 204(2). The magnet 124(2) may traverse between a first position 206(2) and a second position 208(2) while the fluid 204(2) moves through an aperture 212(2) acting to dampen acceleration of the magnet 124(2). The housing 120(2) may include a coupling surface 210(2) and a plate 128(2). In addition, the magnetic coupler 216 may include an exterior 218 shell, which may be an exterior of an object, such as one of the objects 116 shown in FIG. 1B. Thus, when the magnetic coupler 216 is aligned with the magnetic coupler 200, the magnet 124(1) and the magnet 124(2) may traverse towards one another and create a magnetic attraction that couples the coupling surface 210(1) to the coupling surface 210(2). Further details of this coupling are described in FIGS. 3A-3C and FIGS. 4A-4C.

The apertures 212(1), 212(2) may be designed to obtain or achieve a desired movement within the couplers. For example, the apertures may include different cross-sectional profiles (e.g., funnel shape, hour glass shape, etc.). In some embodiments, the apertures may be designed to cause laminar flow when fluid flows in a first direction and cause turbulent flow when the fluid flows in a second, opposite direction.

Figure 3C:
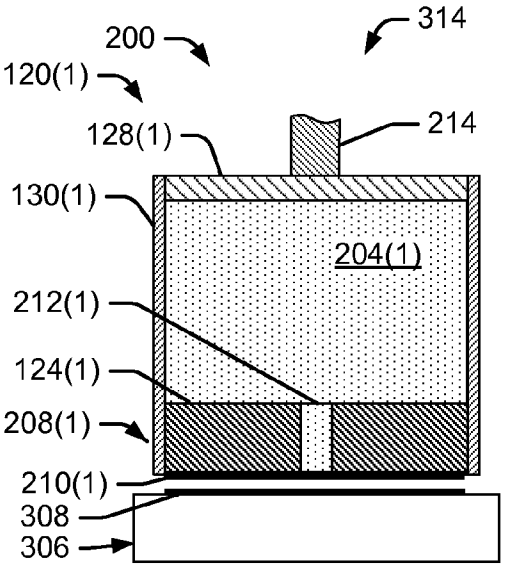
FIGS. 3A-3C are cross-sectional views of the damper and magnetic coupler shown in FIG. 2A, showing various positions of a magnet that moves within the fluid relative to a housing.
Figure 3B:
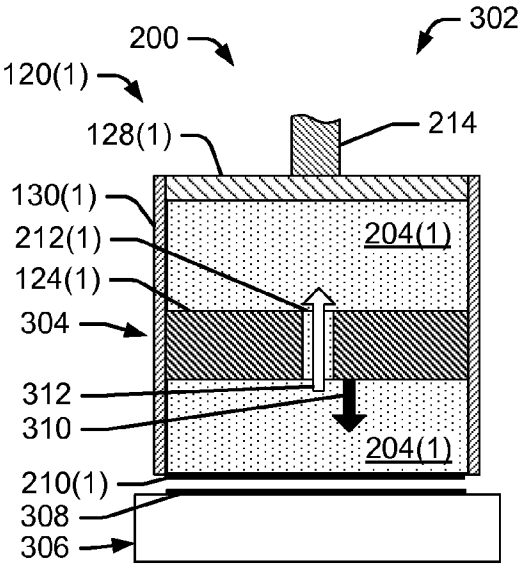
Figure 3A:
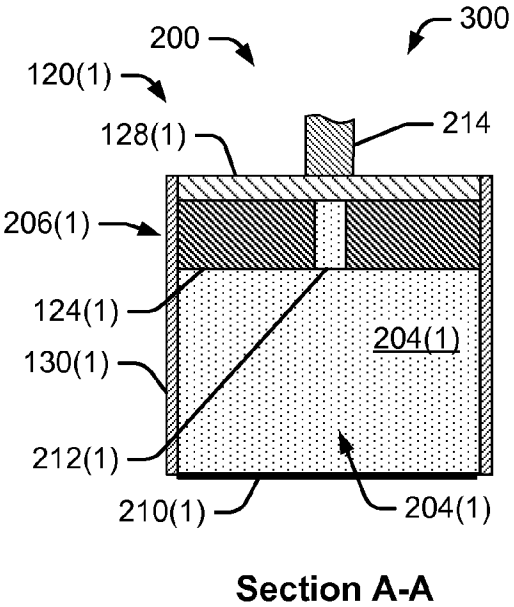

FIGS. 3A-3C are cross-sectional views from Section A-A of the damper and magnetic coupler shown in FIG. 2A, showing various positions of the magnet 120(1) that traverses within the fluid relative to the housing in response to introduction of a fixed object (e.g., another magnet). FIG. 3A shows the magnetic coupler 200 in a retracted state 300 where the magnet 124(1) is located in the first position 206(1). The magnet 124(1) may be located in the first position 206(1) when the magnet has a strongest attraction to the plate 128(1). However, as shown below, when a stronger attraction to another surface is introduced proximate to the coupling surface 210(1), then the magnet 124(1) will traverse to the second position 208(1) shown in FIG. 3C. FIG. 3A also more clearly shows a shield 130(1), which may prevent or limit exposure by other surfaces/objects to an amount of a magnetic force of the magnet 124(1). The shield 130(1) may extend over any portion or surface of the housing 120(1).

FIG. 3B shows the magnetic coupler 200 in an intermediate state 302 where the magnet 124(1) is located at an intermediate position 304 between the first position 206(1) and the second position 208(1). As shown in FIG. 3B, an object 306 is introduced adjacent to the coupling surface 210(1). The object 306 includes a coupling surface 308 and attracts the magnet 124(1) away from the plate 128(1). Thus, the magnetic attraction of the object 306 at a distance from the magnet 124(1) (when the magnet is located in the first position 206(1)) is greater than the magnetic attraction between the magnet 124(1) and the plate 128(1). To traverse from the first position 206(1) shown in FIG. 3A to the intermediate position 304 shown in FIG. 3B, the magnet 124(1) moves toward the coupling surface 210(1) as indicated by an arrow 310. Meanwhile, some of the fluid 204(1) passes through the aperture 212(1) as indicated by an arrow 312. The movement of the fluid 204(1) causes a dampening effect which reduces the acceleration of the magnet 124(1) during the traversing. In some embodiments, the initial movement of the magnet away from the plate may be delayed until the magnet overcomes the attraction to the plate and resistance caused by the dampening effect.

FIG. 3C shows the magnetic coupler 200 in a coupled state 314 where the magnet 124(1) is located in the second position 208(1). As shown in FIG. 3C, the fluid 204(1) has passed through the aperture 212(1) such that little or no fluid remains between the magnet 208(1) and the coupling surface 210(1). In second position, the fluid (or any other dampening mechanism) exerts no force against the magnet. The fluid also does not shield the magnetic force of the magnet 124(1) in the direction of the coupling surface 210(1), thus allowing the magnet 124(1) to maximize an attractive force used to couple the couplings surface 210(1) to the coupling surface 308 of the object 206. When the object is removed (decoupled) from the coupling surface 210(1), and the magnetic attraction of the plate 128(1) becomes stronger than the magnetic attraction caused by the object 306, then the magnet 124(1) may reverse the process illustrated in FIGS. 3A-3C and return to the first position 206(1) shown in FIG. 3A.

Figure 4C:
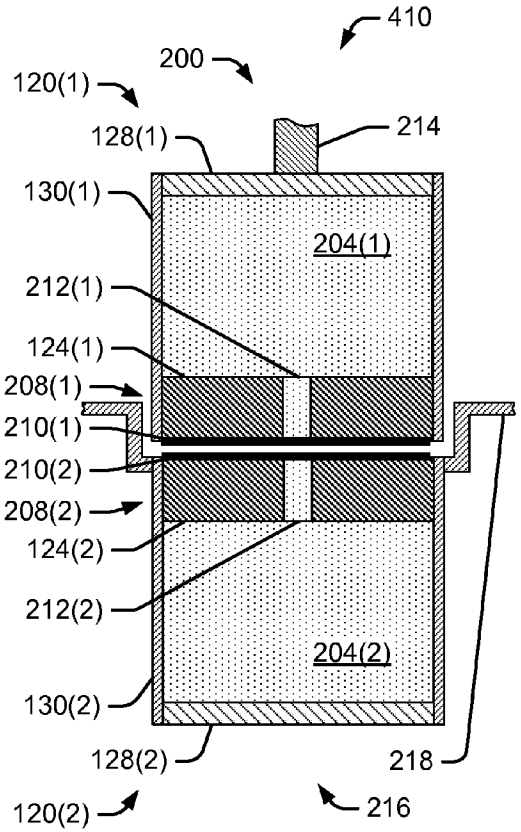
FIGS. 4A-4C show cross-sectional views of the damper and magnetic coupler shown in FIG. 2A engaged to the magnetic coupler shown in FIG. 2B, also shown as cross-sectional views.
Figure 4B:
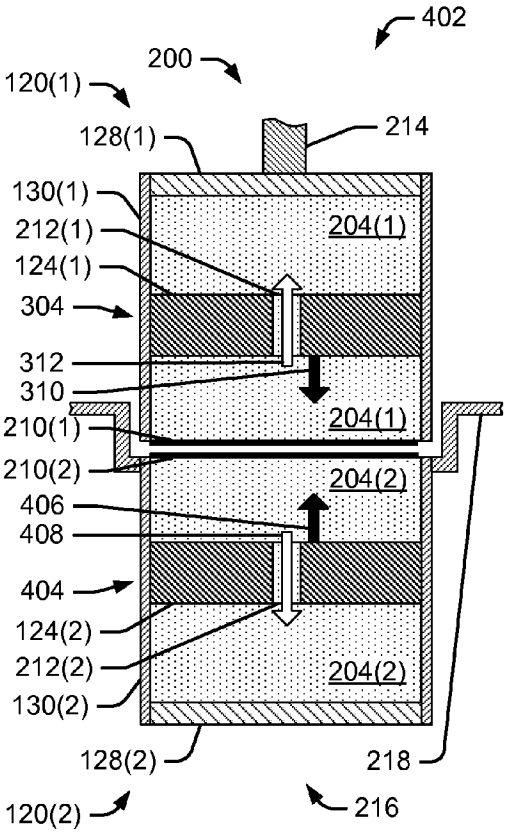
Figure 4A:
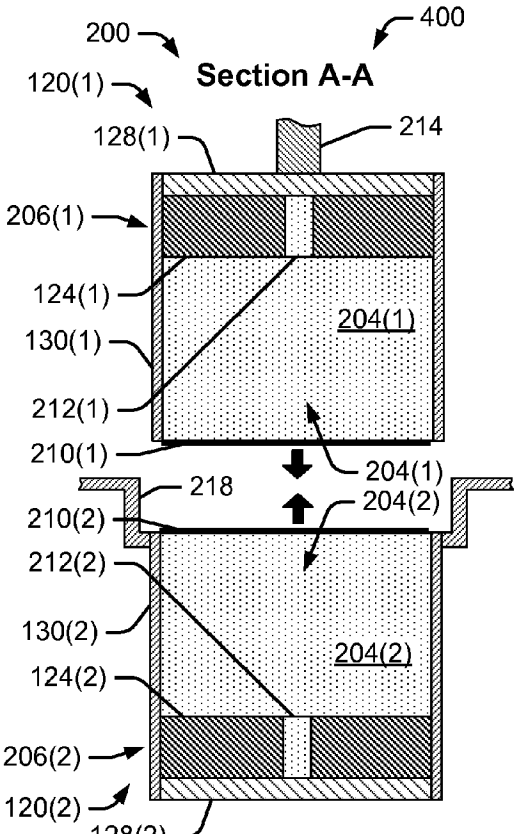

FIGS. 4A-4C show cross-sectional views from Section A-A of the damper and magnetic coupler shown in FIG. 2A engaged to the magnetic coupler shown in FIG. 2B, also shown as cross-sectional views from Section B-B. FIGS. 4A-4C illustrate the traversing of the magnet 124(1) and the magnet 124(2) towards one another in response to coupling or near coupling of the coupling surface 210(1) and the coupling surface 210(2). Thus, FIGS. 4A-4C show a similar process as described with respect to FIGS. 3A-3C, except FIGS. 4A-4C show both coupling objects having a movable magnet.

FIG. 4A shows the magnetic coupler 200 and the magnetic coupler 216 in a retracted state 400 prior to coupling respective coupling surfaces 128(1), 128(2). The magnets 124(1), 124(2) are located in the first position 206(1), 206(2). The magnets 124(1), 124(2) may be located on the first position 206(1), 206(2) when the magnets have a strongest attraction to the respective plates 128(1), 128(2). However, as shown below, when a stronger attraction to another surface is introduced proximate to the coupling surfaces 210(1), 210(2), then the magnets 124(1), 124(2) will traverse to the second position 208(1), 208(2) shown in FIG. 4C.

FIG. 4B shows the magnetic coupler 200 and the magnetic coupler 216 in an intermediate state 402 where the magnets 124(1), 124(2) are located at an intermediate position 304, 404. As shown in FIG. 4B, the coupling surfaces 210(1), 210(2) are moved adjacent to one another, which attracts the magnets 124(1), 124(2) away from the respective plates 128(1), 128(2). Thus, the magnetic attraction from the respective magnets 124(1), 124(2) at a distance apart from one another (when the magnets are located in the first position 206(1), 206(2)) is greater than the magnetic attraction between the magnets and their respective plates 128(1), 128(2). To traverse from the first position 206(1), 206(2) shown in FIG. 4A to the intermediate position 304, 404 shown in FIG. 4B, the magnets 124(1), 124(2) move toward the coupling surfaces 210(1), 210(2) as indicated by an arrow 310 and an arrow 406. Meanwhile, some of the fluid 204(1) passes through the aperture 212(1) as indicated by an arrow 312, while some of the fluid 204(2) passes through the aperture 212(2) as indicated by an arrow 408. The movement of the fluid 204(1), 204(2) causes a dampening effect which reduces the acceleration of the magnets 124(1), 124(2) during the traversing.

FIG. 4C shows the magnetic coupler 200 and the magnetic coupler 216 in a coupled state 410 where the magnets 124(1), 124(2) are located in the second positions 208(1), 208(2). As shown in FIG. 4C, the fluid 204(1), 204(2) has passed through the apertures 212(1), 212(2) such that little or no fluid remains between the magnet 208(1) and the coupling surface 210(1) and between the magnet 208(2) and the coupling surface 210(2). In second position, the fluid (or any other dampening mechanism) exerts no force against the magnet. The fluid also does not shield the magnetic force of the magnets 124(1), 208(2) in the direction of the respective coupling surfaces 210(1), 210(2), thus allowing the magnets to maximize an attractive force used to couple the couplings surface 210(1) to the coupling surface 210(2). When the coupling mechanism 200 is decoupled from the coupling mechanism 216, and the magnetic attraction of the plates 128(1), 128(2) becomes stronger than the magnetic attraction caused by the corresponding magnet, then the magnets 124(1), 124(2) may reverse the process illustrated in FIGS. 4A-4C and return to the first position 206(1), 206(2) shown in FIG. 4A.

Figure 5A:
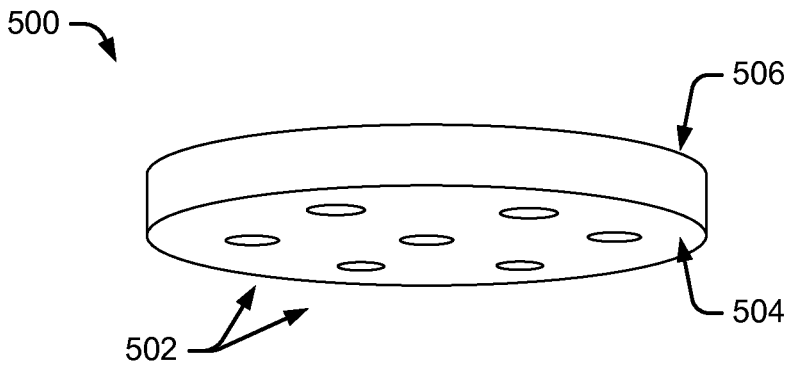
FIGS. 5A and 5B are isometric views of illustrative magnets configured for use in the magnetic couplers shown in FIGS. 2A and 2B.
Figure 5B:
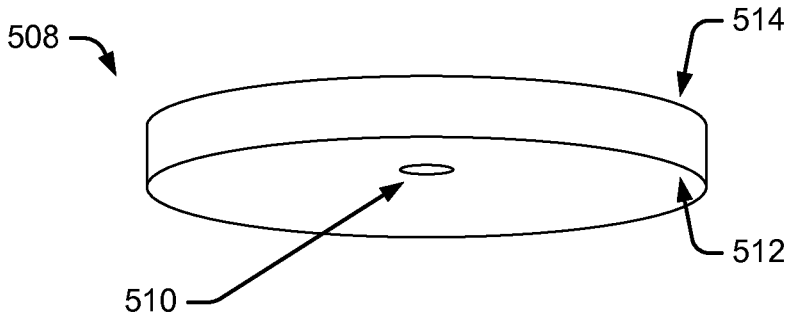

FIGS. 5A and 5B are isometric views of illustrative magnets configured for use in at least the magnetic couplers shown in FIGS. 2A and 2B. FIG. 5A shows an illustrative magnet 500 that includes a plurality of apertures 502. For example, the magnet 500 may include the apertures 502 located around a perimeter of a circumference of the magnet 500. The apertures 502 may be cylindrical or have other shapes. A first surface 504 of the magnet 500 may be parallel or substantially parallel to a second, opposite surface 506 of the magnet. The first surface 504 and the second surface 506 may be planar or substantially planar.

FIG. 5B shows an illustrative magnet 508 that includes at least one aperture 510. The magnet 508 includes a first surface 512 and a second surface 514. At least the first surface 512 may be concave to facilitate flow of the fluid into the aperture 510. In some embodiments, the first side 512 may be situated on a same side of the housing 120(1), 120(2) as the coupling surface 210(1), 210(2) while the second surface 128 may be situated on a same side of the housing (1), 120(2) as the plate 128(1), 128(2).

Figure 6A:
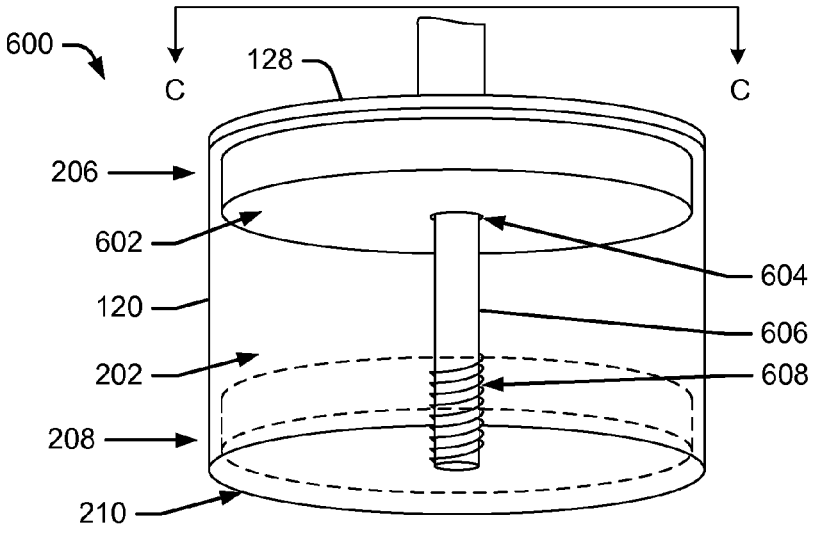
FIG. 6A is an isometric view of a rotational damper for a magnetic coupler.

FIG. 6A is an isometric view of a rotational damper for an illustrative magnetic coupler 600. The magnetic coupler 600 may operate in a similar manner as the magnetic coupler 200 discussed above, in that a magnet 602 traverses from the first position 206 adjacent to the plate 128 to the second position 208 adjacent to the coupling surface 210. When the magnet 602 is in the second position 208 (shown in dashed lines in FIG. 6A), the magnetic attraction proximate to the coupling surface 210 may be maximized and used to magnetically couple to another object or a corresponding magnetic coupler (e.g., as shown in FIGS. 4A-4C). The magnetic coupler 600 may reduce a linear acceleration of the magnet 602 during at least part of the traversing from the first position 206 to the second position 208 by causing the magnet to rotate during at least a portion of the traversing. Thus, as least some kinetic energy of the magnet may be dissipated by the rotation.

As shown in FIG. 6A, the magnet 602 may include an aperture 604 that is centrally located in the magnet 602 to enable the magnet to rotate without contacting exterior walls of the hosing 120. The internal cavity 202 may include a spline 606 that longitudinally extends between the plate 128 and the coupling surface 210. The spline 606 may guide the magnet 602 while the magnet 602 traverses between the first position 206 and the second position 208. The spline 606 may include threads 608, which when engaged in corresponding threads 610 of the aperture (shown in FIG. 6C), cause the magnet 602 to rotate. The threads 608 may extend from an end of the spline 606 that is proximate to the coupling surface 210 at least part way toward the opposite end of the spline 606 that is proximate to the plate 128. The threads 608 may extend part way along the spline 606 or along the entire spline 606.

Figure 6B:
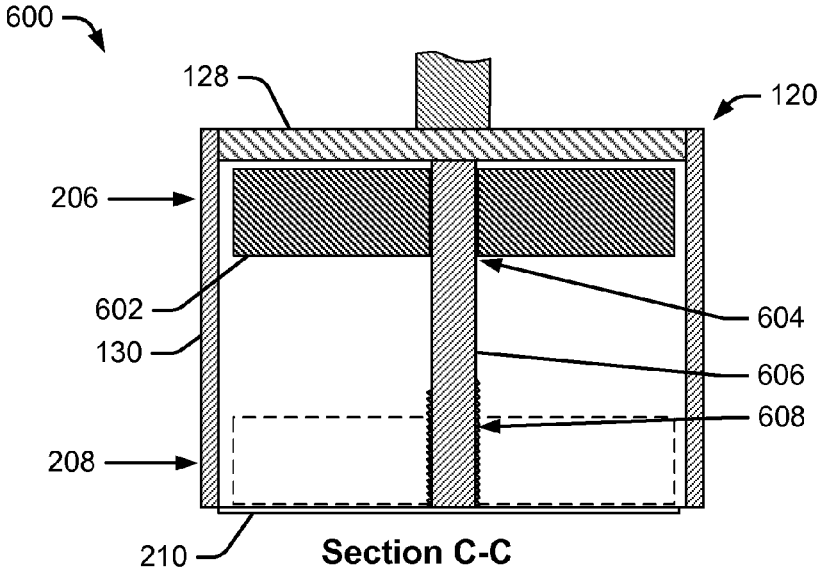
FIG. 6B is a cross-sectional view of the rotational damper and magnetic coupler shown in FIG. 6A.
Figure 6C:
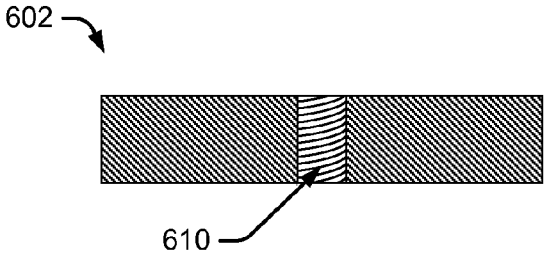
FIG. 6C is a cross-sectional view of the magnet shown in FIG. 6A.

FIG. 6B is a cross-sectional view from Section C-C of the rotational damper and the magnetic coupler 600 shown in FIG. 6A. FIG. 6C is a cross-sectional view from Section C-C of the magnet shown in FIG. 6A.

Figure 6D:
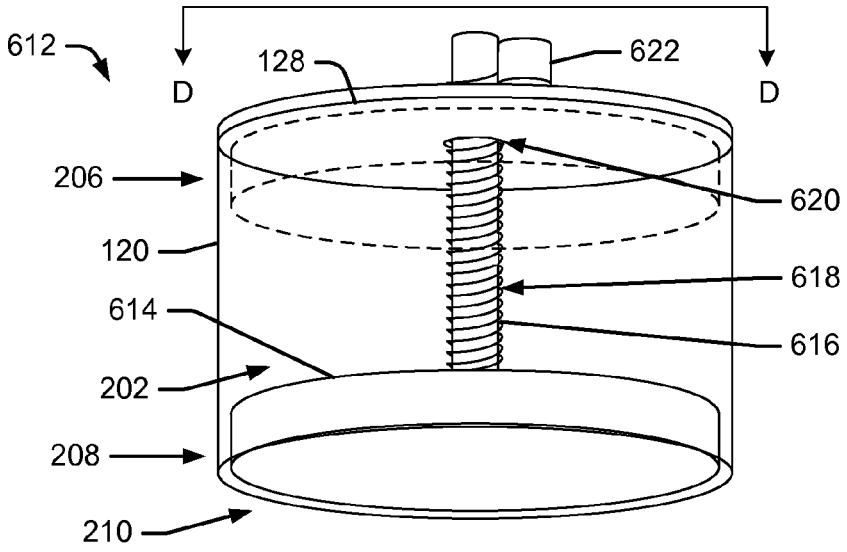
FIG. 6D is an isometric view of another rotational damper for a magnetic coupler.

FIG. 6D is an isometric view of another rotational damper for another magnetic coupler 612. The magnetic coupler 612 is similar to the magnetic coupler 600 in that the magnetic coupler 612 includes a magnet 614 that rotates to reduce linear acceleration of the magnet during traversing between the first position 206 and the second position 208. However, the magnet 614 may be coupled (e.g., fixed, integrally formed, attached, etc.) to a spline 616, which includes threads 618 that engage in corresponding threads in an aperture 620 of the plate 128. Thus, when the magnet is located in the first position 206, the spline 616 may project through the aperture 620. The spline 620 may physically interact with a roller damper 622, such as by the roller damper contacting a surface of the spline to slow rotation of the spline. The dampening roller 622 may slow rotation of the spline 616 during rotation in at least one direction, such as the direction the causes the magnet 614 to traverse toward the second position 208. In some embodiments, the roller 622 may be configured to provide more or less resistance depending on the direction of rotation of the roller.

Figure 6E:
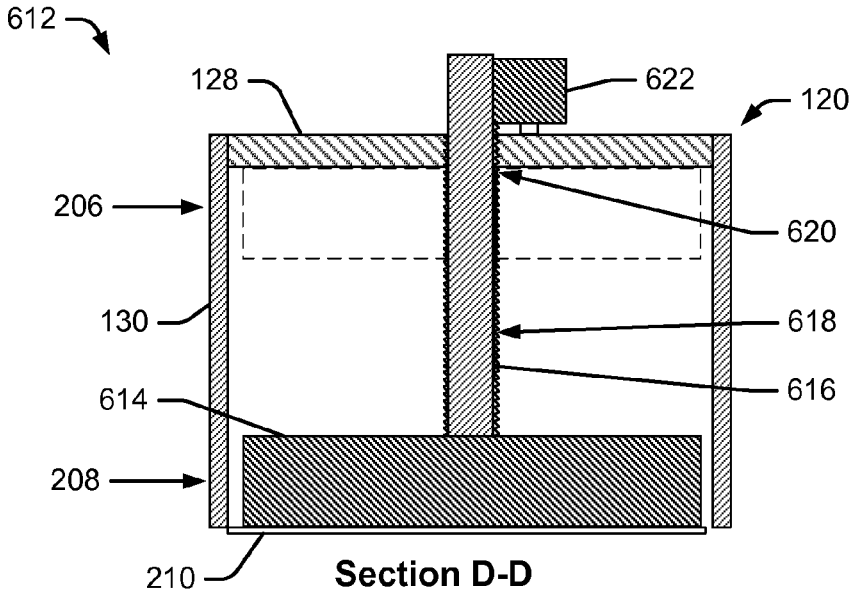
FIG. 6E is a cross-sectional view of the rotational damper and magnetic coupler shown in FIG. 6D.

FIG. 6E is a cross-sectional view from Section D-D of the rotational damper and the magnetic coupler 612 shown in FIG. 6D. In some embodiments, the magnetic coupler 600 and/or the magnetic coupler 612 may include fluid or gas with a sealed housing to act to damper movement of the magnet.

Figure 7A:
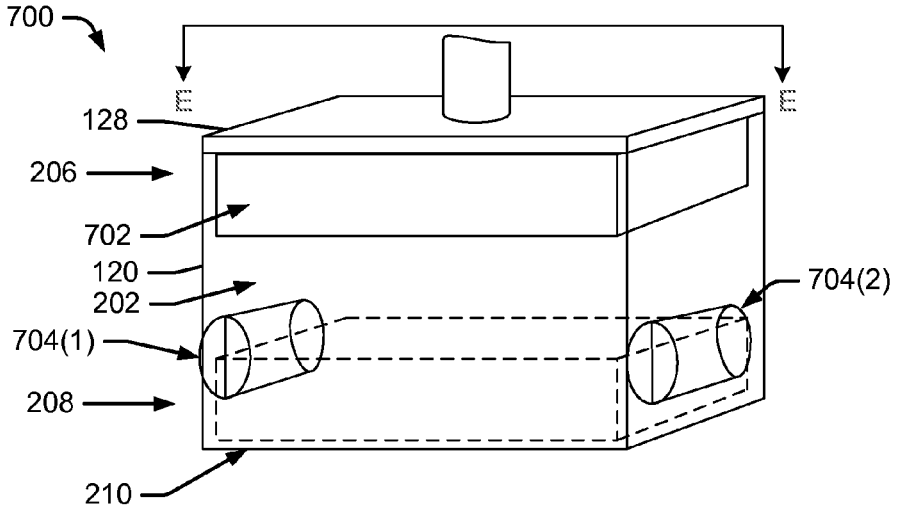
FIG. 7A is an isometric view of a roller damper for a magnetic coupler.

FIG. 7A is an isometric view of a roller damper for an illustrative magnetic coupler 700. The magnetic coupler 700 may operate in a similar manner as the magnetic coupler 200 discussed above, in that a magnet 702 traverses from the first position 206 adjacent to the plate 128 to the second position 208 adjacent to the coupling surface 210. When the magnet 702 is in the second position 208 (shown in dashed lines in FIG. 7A), the magnetic attraction proximate to the coupling surface 210 may be maximized and used to magnetically couple to another object or a corresponding magnetic coupler (e.g., as shown in FIGS. 4A-4C). The magnetic coupler 700 may reduce an acceleration of the magnet 702 during at least part of the traversing from the first position 206 to the second position 208 by dissipating kinetic energy of the magnet 702 through use of rollers 704(1), 704(2).

Figure 7B:
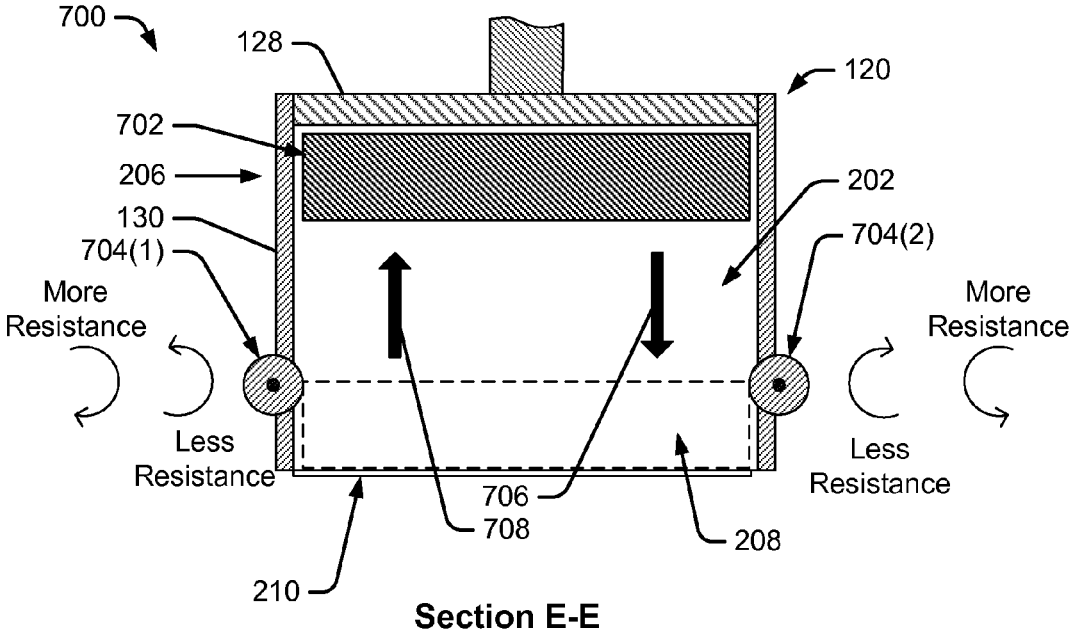
FIG. 7B is a cross-sectional view of the roller damper and magnetic coupler shown in FIG. 7A.

FIG. 7B is a cross-sectional view from Section E-E of the roller damper and the magnetic coupler 700 shown in FIG. 7A. As shown in FIG. 7B, the magnet 702 may engage the rollers 704(1), 704(2) just prior to the magnet 702 being located at the second position 208, such that the acceleration of the magnet 702 is slowed before the magnet assumes the second position 208. The rollers 704(1), 704(2) may continue to engage the magnet 702 while the magnet 702 is located at the second position 208. In some embodiments, the rollers 704(1), 704(2) may be configured to provide more or less resistance depending on the direction of rotation of the rollers. As shown in FIG. 7B, the roller 704(1) may provide more resistance when rotating clockwise (as viewed from the perspective in FIG. 7B) than when rotating counterclockwise. The roller 704(2) may provide more resistance when rotating counterclockwise (as viewed from the perspective in FIG. 7B) than when rotating clockwise. Thus, when the magnet 702 is traversing in a first direction 706 toward the coupling surface 210 and in contact with the rollers 704(1), 704(2), the rollers may provide more resistance than when the magnet 702 is traversing in a second direction 708 toward the plate 128 and in contact with the rollers 704(1), 704(2). In some embodiments, the rollers 704(1), 704(2) may include a freewheel that allows the rollers to rotate with less resistance when the magnet 702 is traversing in the second direction 708 toward the plate 128. For example, the freewheel may include movable teeth that disengage from a portion (e.g. a mass) of the roller, and allow rotation in one direction with less resistance since the disengaged portion is not rotated. The additional resistance provided by the rollers 704(1), 704(2) may be due to rotation of additional mass when the teeth engage the portion (e.g., the mass). Other techniques to modify rolling resistance of rollers may be applied in a similar configuration.

In some embodiments, the magnetic coupler 700 may include one more of guide features and/or spline to guide the magnet 702 during the traversing between the first position 206 and the second position 208. The guide features and/or spline may align the magnet to provide substantially equal contact with the rollers 704(1), 704(2). In various embodiments, additional rollers may be used to reduce acceleration of the magnet 702 during the traversing from the first position 206 to the second position 208. The rollers 704(1), 704(2), and the roller 622 may be similar or the same type of rollers.

Figures 8A, 8B, 8C:
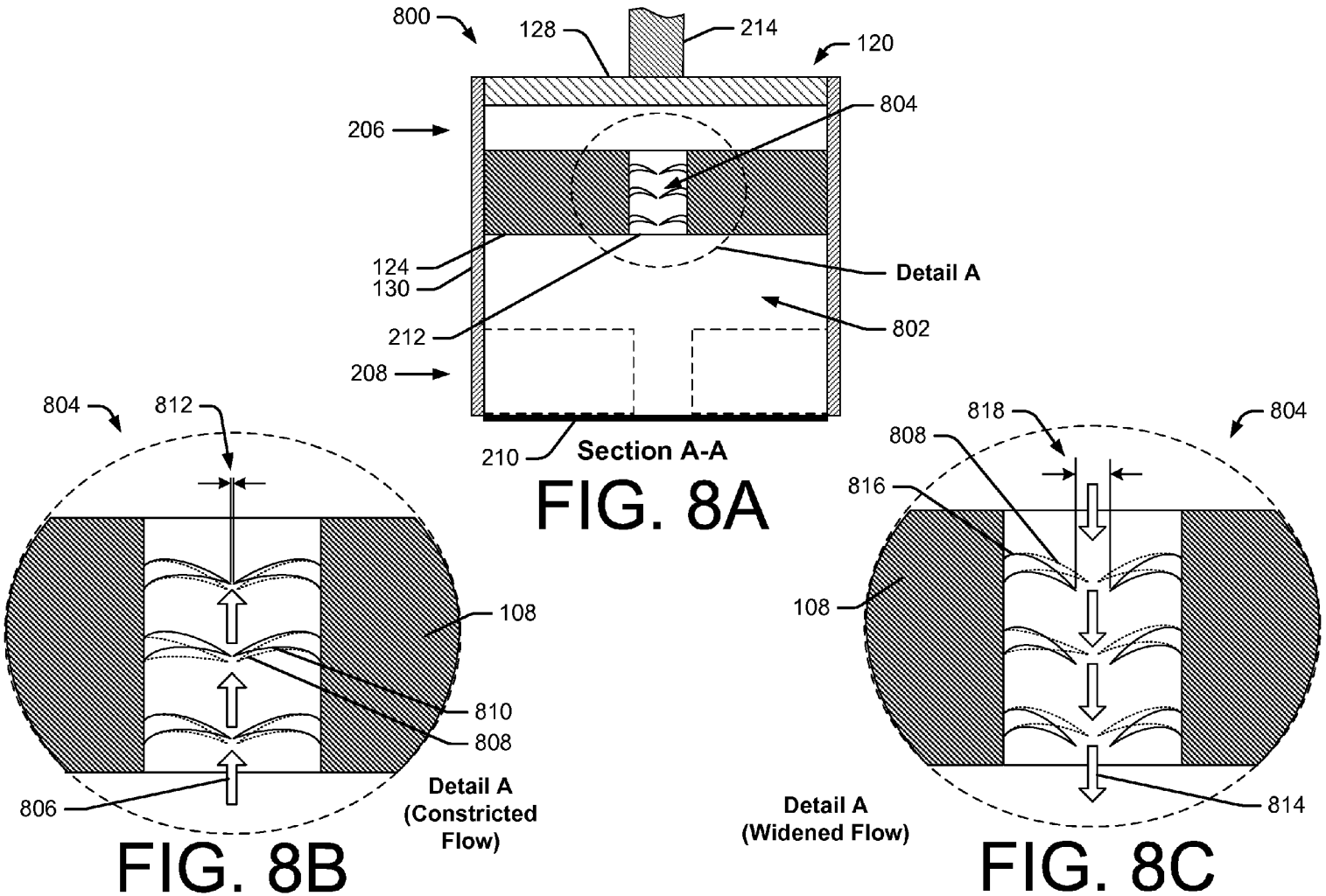
FIG. 8A is a cross-sectional view of some embodiments of the damper and magnetic coupler shown in FIG. 2A.
FIGS. 8B and 8C are detailed views from FIG. 8A showing the damper for the magnetic coupler as gas travels through the damper in different directions.

FIG. 8A is a cross-sectional view of some embodiments of an illustrative damper 800 usable with the magnetic coupler 200 shown in FIG. 2A. The damper 800 may accommodate flow of gas 802. The damper 800 may be used with liquid; however the following discussion focuses on use of gas in the discussion of the operation of the damper 800. To accommodate use of the gas 802, the damper 800 may include fins 804 that may constrict or widen a passage through the aperture 212 depending on a direction of flow of the gas 802 (or fluid). Additional details of the fins shown are Detail A is provided below.

FIG. 8B shows the Detail A where the fins 804 are in a constricted configuration. When a flow of the gas 802 is in a first direction 806, the fins may deflect or otherwise move from a default position 808 to a constricted position 810 based at least in part on the flow of the gas in the first direction 806. Thus, the shape of the fins may cause the fins to deflect or otherwise move into the constricted position 810 as a result of the flow of the gas in the first direction 806, and thereby constrict a passage through the aperture 212 to a constricted width 812. The default position 808 may be assumed when gas does not flow through the fins. Gas may be caused to flow through the fins 804 in response to movement of the magnet 124 as discussed above with respect to FIGS. 3A-3C, for example.

FIG. 8C shows the Detail A where the fins 804 are in a widened configuration. When a flow of the gas 802 is in a second direction 814, the fins may deflect or otherwise move from the default position 808 to a widened position 816 based on the flow of the gas in the second direction 814. Thus, the shape of the fins may cause the fins to deflect or otherwise move into the widened position 816 as a result of the flow of the gas in the second direction 814, and thereby widen a passage through the aperture 212 to a widened width 818 (as compared to the constricted width 812 shown in FIG. 8B).

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A connector comprising:

a housing that includes at least:

a sealed fluid reservoir having a top end and a bottom end opposing the top end, a coupling surface located proximate to the bottom end of the fluid reservoir and configured to couple to a corresponding surface of a different object, and a ferrous plate located proximate to the top end of the fluid reservoir;

fluid contained within the sealed fluid reservoir; and a magnet contained within the sealed fluid reservoir, the magnet configured to traverse within the sealed fluid reservoir between a first position and a second position, the magnet configured to couple the coupling surface to the corresponding surface when the magnet is located at the second position, the magnet including at least one aperture that extends between an upper surface and a lower surface of the magnet to allow the fluid to pass through the at least one aperture as the magnet traverses between the first position and the second position, wherein the movement of the fluid through the at least one aperture is in a direction opposite a direction of travel of the magnet and acts to dissipate kinetic energy of the magnet as the magnet traverses between the first position and the second position, and wherein the ferrous plate attracts the magnet to the first position in an absence of a stronger attractive force from the different object that includes the corresponding surface.

2. The connector as recited in claim 1, wherein the magnet is at least one of a rare earth magnet, a composite magnet, a ferromagnet, or an electromagnet.

3. The connector as recited in claim 1, wherein the fluid includes glycerin.

4. The connector as recited in claim 1, wherein the at least one aperture includes a cross-sectional profile that creates turbulent flow of the fluid as the fluid flows through the at least one aperture.

5. An apparatus comprising:

a housing that includes a coupling surface;

a magnet that traverses within the housing between a first position and a second position, the magnet causing the coupling surface to couple to a corresponding surface when the magnet is located in the second position;

a ferrous plate located proximate to the first position, the ferrous plate to attract the magnet to the first position in absence of a stronger attractive force from another object that includes the corresponding surface; and a dampening mechanism to dissipate kinetic energy of the magnet as the magnet traverses from the first position to the second position, the dampening mechanism including at least one of a fluid or a gas that is displaced by the magnet to dissipate the kinetic energy as the magnet traverses between the first position and the second position.

6. The apparatus as recited in claim 5, further comprising a shield to magnetically insulate at least a portion of the housing to limit exposure to a magnetic field caused by the magnet.

7. The apparatus as recited in claim 5, wherein the dampening mechanism includes at least one of a spline or a guide feature to control directional movement of the magnet when the magnet traverses between the first position and the second position.

8. The apparatus as recited in claim 5, wherein the magnet includes at least one aperture that extends through the magnet to allow the fluid or gas to pass through the magnet as the magnet traverses between the first position and the second position.

9. The apparatus as recited in claim 8, wherein the at least one aperture includes a cross-sectional profile that creates turbulent flow of the fluid as the fluid flows through the at least one aperture.

10. The apparatus as recited in claim 5, wherein the dampening mechanism comprises a threaded spline that extends between a first surface of the housing and a second surface of the housing that is opposite the first surface, the threaded spline to engage corresponding threads in the magnet or the housing to cause rotation of the magnet during the traversing between the first position and the second position.

11. The apparatus as recited in claim 5, wherein the fluid includes at least one of glycerin or corn syrup.

12. The apparatus as recited in claim 5, wherein the dampening mechanism comprises a valve coupled to the magnet and located in the aperture, the valve configured to translate between a constricted state and a widened state based at least in part on a direction of flow of the fluid or the gas through the aperture, the valve configured to be in the constricted state when the magnet traverses from the first position to the second position.

13. The apparatus as recited in claim 5, wherein the magnet is at least one of a rare earth magnet, a composite magnet, a ferromagnet, or an electromagnet.

14. A coupling system comprising:

a housing that includes a coupling surface and a sealed cavity;

a magnet that traverses between a first position and a second position within the sealed cavity, the magnet configured to couple the coupling surface of the housing to an object when the magnet is located in the second position;

a ferrous plate located proximate to the first position, the ferrous plate to attract the magnet to the first position in an absence of a stronger attractive force from the object; and a dampening mechanism to reduce a linear acceleration of the magnet when the magnet traverses from the first position to the second position, the dampening mechanism engaging the magnet directly or indirectly to reduce the linear acceleration of the magnet.

15. The apparatus as recited in claim 14, further comprising a shield to magnetically insulate at least a portion of the housing.

16. The apparatus as recited in claim 14, wherein the magnet is at least one of a rare earth magnet, a composite magnet, a ferromagnet, or an electromagnet.

17. The coupling system as recited in claim 16, wherein the dampening mechanism comprises a valve coupled to the magnet and located in the aperture, the valve configured to translate between a constricted state and a widened state based at least in part on a direction of flow of the fluid or the gas through the aperture, the valve configured to be in the constricted state when the magnet traverses from the first position to the second position.

18. The apparatus as recited in claim 16, further comprising wherein the at least one aperture includes a cross-sectional profile that creates turbulent flow of the fluid as the fluid flows through the at least one aperture.

19. The coupling system as recited in claim 14, wherein the magnet includes at least one aperture that extends through the magnet to allow a fluid or a gas to pass through the magnet as the magnet traverses between the first position and the second position.

20. The apparatus as recited in claim 19, wherein the fluid includes at least one of glycerin or corn syrup.

* * * * *